US006866774B1

(12) United States Patent
Stephenson

(10) Patent No.: US 6,866,774 B1
(45) Date of Patent: Mar. 15, 2005

(54) PORTABLE POOL CLEANING SYSTEM

(76) Inventor: Michael Charles Stephenson, 6838 Bob-o-Link Dr., Dallas, TX (US) 75214

( * ) Notice: Subject to any disclaimer, the term of this patent is extended or adjusted under 35 U.S.C. 154(b) by 0 days.

(21) Appl. No.: 10/424,520

(22) Filed: Apr. 28, 2003

(51) Int. Cl.[7] ..... E04H 4/16

(52) U.S. Cl. ..... 210/169; 210/238; 210/416.2; 4/490

(58) Field of Search ..... 210/169, 232, 210/238, 416.1, 416.2; 15/1.7; 4/490

(56) References Cited

U.S. PATENT DOCUMENTS 3,012,676 A 12/1961 Englesberg
3,036,712 A * 5/1962 Barbara ..... 210/169
3,797,508 A 3/1974 Jacobs
4,022,690 A * 5/1977 Smith ..... 210/169
4,240,174 A 12/1980 Thiem et al.
4,581,075 A 4/1986 St. Martin
4,801,376 A 1/1989 Kulitz
4,801,378 A * 1/1989 Desjoyaux et al. ..... 210/169
5,018,890 A * 5/1991 May ..... 401/46
5,234,583 A * 8/1993 Cluff ..... 210/169
5,317,776 A * 6/1994 DeMoura ..... 15/1.7
5,725,761 A * 3/1998 Phillips ..... 210/169
6,365,039 B1 * 4/2002 Henkin et al. ..... 210/103
6,407,469 B1 * 6/2002 Cline et al. ..... 307/11

* cited by examiner

*Primary Examiner*—Fred G. Prince
(74) *Attorney, Agent, or Firm*—R. Scott Rhoades; Winstead Sechrest & Minick P.C.

(57) ABSTRACT

A portable pool cleaning system for the remote cleaning of a swimming pool including a housing and a base. A motor is connected to the housing and is attached to a high pressure pump wherein the pump includes both intake and ports. The first tubing is connected to the intake port and the opposite end is inserted into the swimming pool for the transportation of water from the swimming pool to the pump. A second tubing is connected to an output port of the high pressure pump with the opposite end of the second tubing placed into the swimming pool and attached to a self-propelled cleaning device. The self-propelled cleaning device uses a high pressure water stream as a scrubbing function. The motor is connected to a timer which is connected to a power source. The timer initiates the activation and deactivation of the motor and the self-propelled cleaning device. A means for attaching the base and portable pool cleaning system to the periphery of the swimming pool is also included.

9 Claims, 4 Drawing Sheets

PORTABLE POOL CLEANING SYSTEM

CROSS-REFERENCE TO RELATED APPLICATIONS

Not Applicable.

STATEMENT REGARDING FEDERALLY SPONSORED RESEARCH/DEVELOPMENT

Not Applicable.

FIELD

The present invention is related to a pool cleaner and more particularly to a portable pool cleaner for use with swimming pools.

BACKGROUND

In recent years swimming pools have transitioned from large, community based pools to smaller individual pools. Most communities still provide the "City" pool; however, apartment complexes, homeowner's associations and many individual homes have permanent, in-ground swimming pools which primarily reserve use of the pools for members of the complex, association or the home owner. As these pools are typically smaller in scale and are not used as revenue generating tools, the costs of pool supporting equipment can become onerous. Pool cleaning systems fall into this expensive category.

Pool cleaning systems are typically built as a permanent addition to the in-ground pool. However, as the complexity and costs of these systems increased, swimming pool owners began to request alternatives to these large cleaning systems. To meet this need, portable pool cleaning systems were developed. An example of such a portable pool cleaning system is disclosed in U.S. Pat. No. 5,018,890 entitled "Pool Cleaning System" which is assigned to the North Broadway Corporation. This patent discloses a portable pool cleaning system for cleaning the surfaces of the swimming pools and the surrounding decks. This cleaning is accomplished without the necessity of draining the swimming pool. The system includes a cart for containing an electric pump and lines, one to a cleaning agent and one to a clean water source. The system implements a wand for scrubbing the walls and base of the swimming pool and the surrounding deck. This system requires the user to clean the pool and deck by scrubbing with the wand and then requires the user to add additional chemicals to the pool to counteract the cleaning agents.

In another example, a portable pool cleaning system is disclosed in U.S. Pat. No. 4,240,174 entitled "Self-Contained Mobile Pool Cleaning Apparatus" awarded to James F. Thiem and Jeffrey L. Scott. In this disclosed system, the cleaning apparatus includes a self-contained pump, filter and driving motor mounted on a hand wheeled truck and housed in a waterproof enclosure. The system further discloses a sweeper head that moves along the bottom and side walls of the pool in the usual manner by a hingedly mounted wand. This system requires the user to clean the pool by scrubbing with the wand.

These disclosed systems require the user to manually scrub the bottom and walls of the pool with the wand of the portable pool cleaning systems. Therefore, any advancement in the ability to remotely initiate and complete the cleaning would be greatly appreciated.

SUMMARY

A portable pool cleaning system for the remote cleaning of a swimming pool including a housing and a base is disclosed. A motor is connected to the housing and drives a high pressure pump. The pump includes both intake and output ports with a first tubing connected to the intake port with the distal end inserted into the swimming pool for the transportation of water from the swimming pool to the pump. A filtration system is attached to the intake port of the high pressure pump or to the first tubing. The filtration system removing foreign materials and debris from the swimming pool water. A second tubing is connected to the output port of the pump with the distal end placed into the swimming pool and attached to a self-propelled cleaning device. The self-propelled cleaning device uses a high pressure water stream from the pump to assist in the scrubbing function. The motor is controlled by a timer which is connected to a power source. The timer initiates the activation and deactivation of the motor and the self-propelled cleaning device. A means for attaching the base and portable pool cleaning system to the periphery of the swimming pool is also included. The means allows for quick attachment/detachment of the portable pool cleaning system to the deck or periphery of the swimming pool while providing a safe and secure environment.

BRIEF DESCRIPTION OF THE DRAWINGS

For a more complete understanding of the present invention, and for further details and advantages thereof, reference is now made to the following Detailed Description taken in conjunction with the following drawings, in which.

DETAILED DESCRIPTION OF THE DRAWINGS

Figure 1:
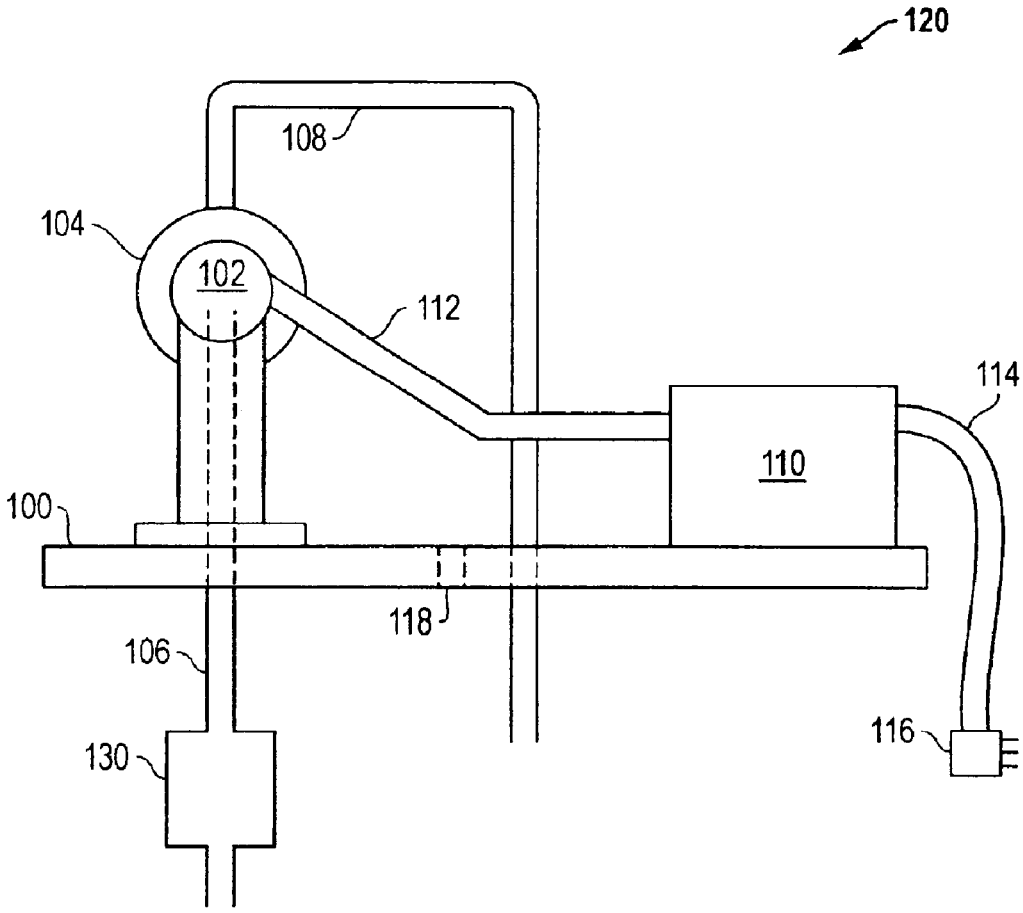
FIG. 1 is a front view of a portable pool cleaning system according to the invention.

In the descriptions which follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
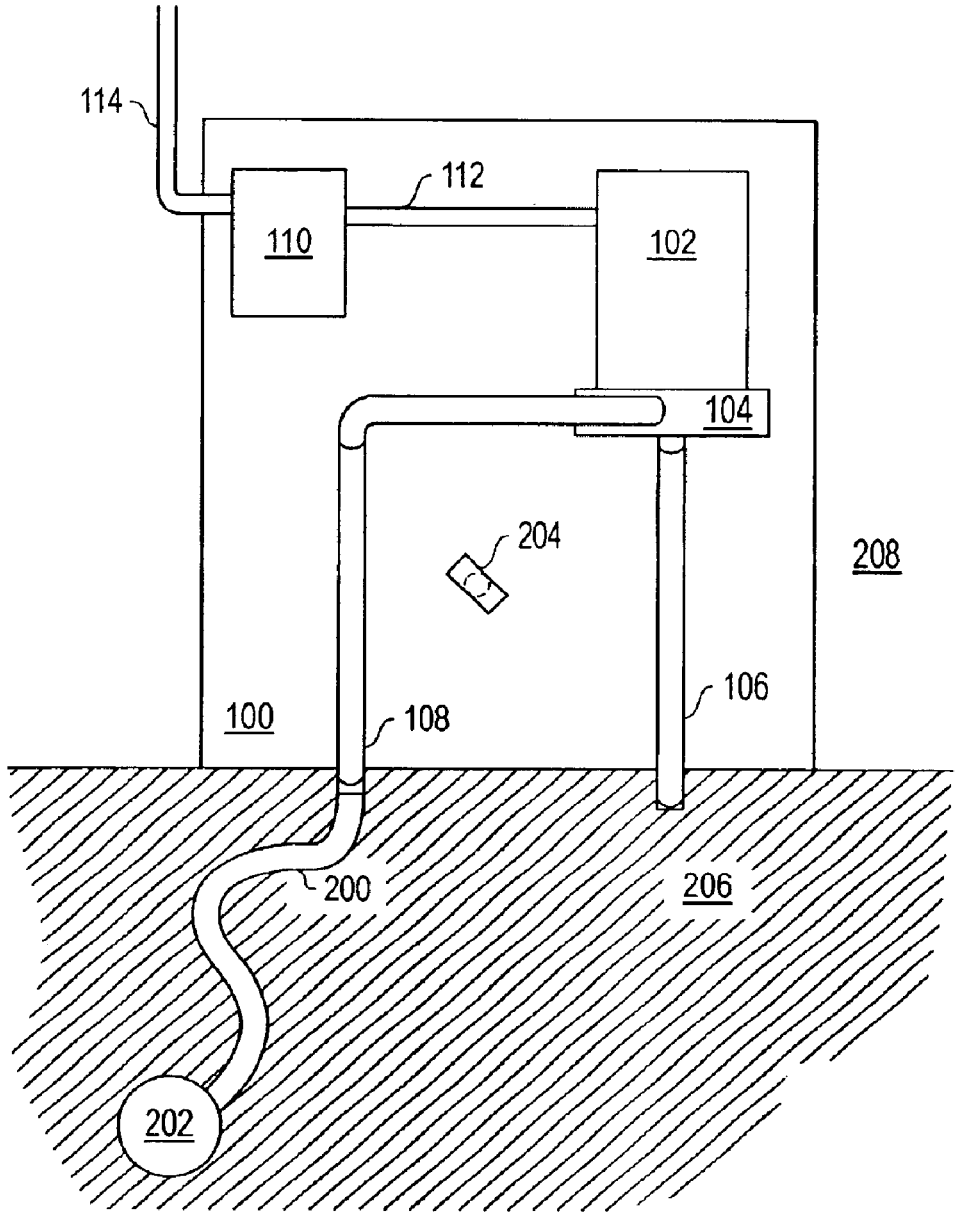
FIG. 2 is a top view of a portable pool cleaning system according to the invention installed at the swimming pool.
Figure 5:
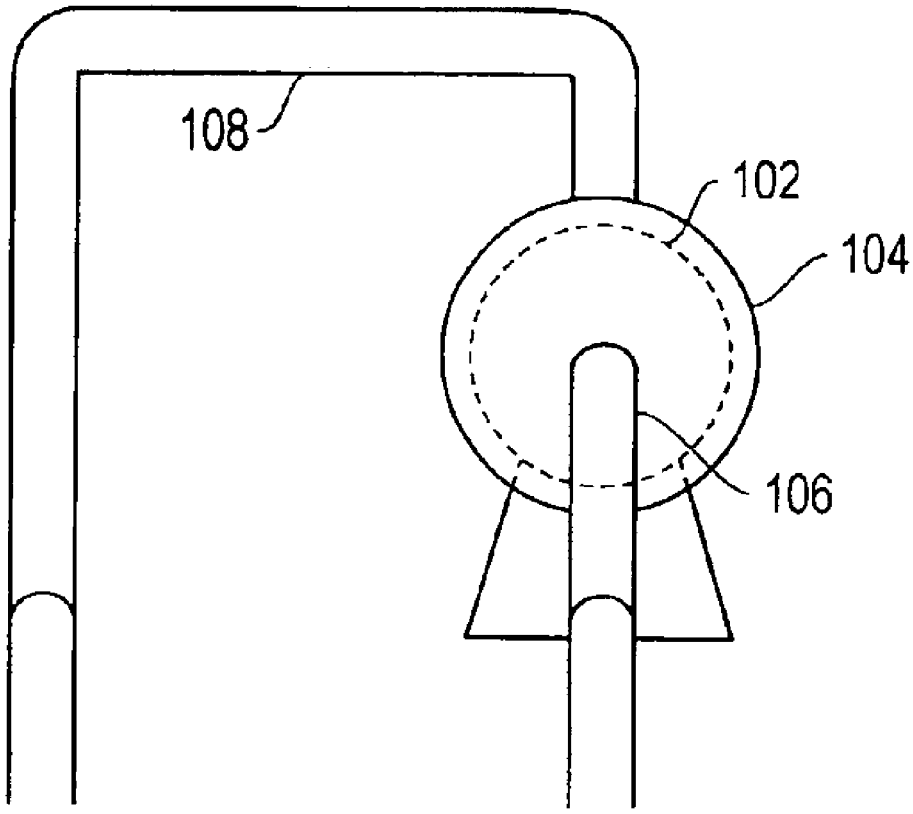
FIG. 5 is a back view of the tubing, pump and motor system of the portable pool cleaning system.

Referring now to FIGS. 1, 2 and 5, a portable pool cleaning apparatus and system is shown. The portable pool cleaning system 120 includes a base 100 which is temporarily attachable to the periphery or deck 208 of a swimming pool 206. The attachment may be through a bolt or wing nut 204 through a guide hole 118 in the base 100 or through other quick attachment functions disclosed in more detail herein. A motor 102 is mounted to the base 100. The motor 102 may include both electric motors such as a 120 volt 20 amp electric motor or may include alternate power motors such as gas or diesel powered motors. The motor 102 is attached to a timer 10 which is also mounted to the base 100. The motor 102 is attached to the timer 110 through electrical line 112. The timer 110 is a standard timer known to those skilled in the art which allows for the initiation and deactivation of the motor 102 at either preset times or for a limited specific time period. Power line 114 is connected to the timer 110 and attaches the portable pool cleaning system 120 to a power source (not shown). A ground fault protection device such as a ground fault interrupter (GFI) 116 may be placed between the power source and the timer 110. The ground fault interrupter 116 triggers when a ground fault current is greater than a preset threshold value. The trigger disables the ground fault interrupter 116 and thus stops the flow of electrical current from the power source to the portable pool cleaning system 120. A typical circuit breaker interrupts the circuit at 20 amperes, but it takes only about 100 milliamperes to electrocute a person. The GFI 116 is designed to detect currents of a few milliamperes and trip a breaker at the receptacle or at the breaker panel to remove the shock hazard. Inclusion of the ground fault protection device is desirable as the electrical motor 102 of the portable pool cleaning system 120 is located close to the swimming pool water when in use and prevents accidental electrocution caused by inadvertent contact with the portable pool cleaning system 120. GFI's 116 may be required by the electrical code for receptacles in bathrooms, some kitchen receptacles, some outside receptacles, and receptacles near swimming pools.

A high pressure pump 104 is connected to and driven by the motor 102. The high pressure pump 104, in one disclosed embodiment, is a 0.75 horsepower (hp) booster pump. The pump 104 includes both an intake port which is connected to an intake tubing 106 and an output port which is connected to the output tubing 108. The intake tubing 106 includes both a proximate end and a distal end. The proximate end of the intake tubing 106 is connected to the intake port of the pump 104. The intake tubing 106 extends outwardly from the intake port of the pump 104 before turning down and extending into the swimming pool. The intake tubing 106 then allows for the transport of water from the swimming pool 206 to the pump 104. The output tubing 108 also includes both proximate and distal ends. The proximate end of the output tubing 108 is connected to the output port of the pump 104. The tubing extends outwardly from the output port 104. The output tubing 108 extends upwardly from the pump 104 and forms a square or box turn before descending toward the swimming pool 206. This square or box turn also forms a handle by which an individual may grasp the portable pool cleaning system 120. The distal end of the output tubing 108 extends into the swimming pool 206. The output tubing 108 transports water from the pump 104 and returns it to the swimming pool 206. The intake tubing 106 or the pump 104 may include a filtration system 130 which filters out debris and other particles contained within the swimming pool 206. The filtration system 130 may be removable and/or cleanable as known to those skilled in the art. The filtration system 130 may be located near or as part of the high pressure pump 104 or may be located on the intake tubing 106, either above or below the water line. A pool sweep cleaning device 202 is attached to a pool sweep tubing 200 which connects to the output tubing 108. The pool sweep device 202 is a high pressure cleaner which scrubs the bottom and sides of the swimming pool with high pressured water to remove unwanted debris and particles. In one disclosed embodiment, the pool sweep device 202 requires the presence of a dedicated high pressure pump 104 and motor 102.

The portable pool cleaning system 120 is compact and built of light weight materials and is easily transportable though the efforts of one individual. A variety of swimming pools 206 may be cleaned using this portable pool cleaning system 120. Such pools include above and below ground pools. In a typical system, around the periphery of the pool is a pool deck made of a variety of materials. The portable pool cleaning system 120 can be placed on the pool deck 208 so that the intake and output tubings 106 and 108 respectively, extend beyond the edge of the pool deck 208 and extend into the water of the swimming pool 206.

Figure 3:
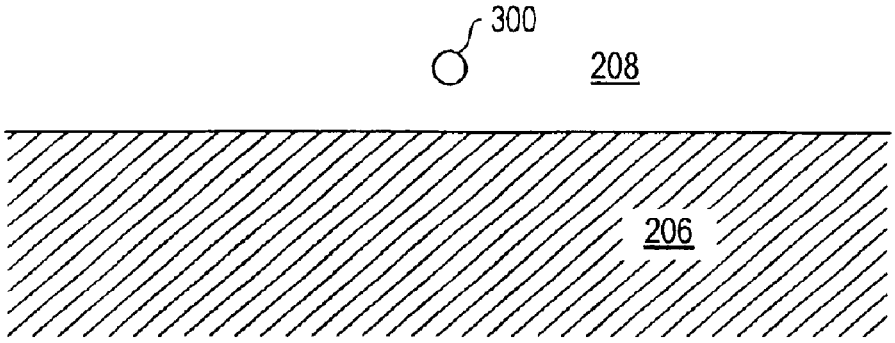
FIG. 3 is a top view of the swimming pool showing an embedded threaded pipe for attaching the pool cleaning system to the swimming pool.
Figure 4:
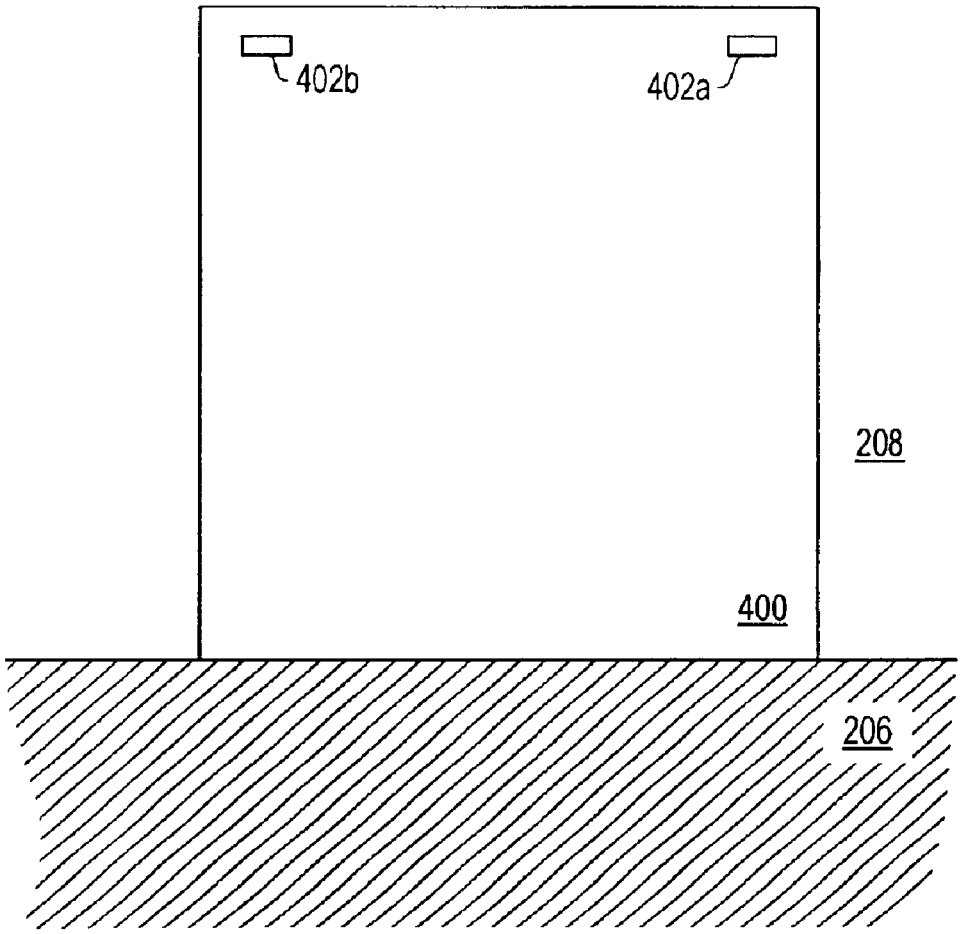
FIG. 4 is a top view of the swimming pool showing a physically attached secondary base with quick attach connections for attaching the portable pool cleaning system.

FIGS. 3 and 4 show alternate embodiments of the attachment functions of the portable pool cleaning system to the pool deck. Referring now to FIG. 3, one disclosed embodiment of the attachment of the system to a pool deck is shown. A prethreaded pipe 300 is permanently inserted into the pool deck 208. The prethreaded pipe 300 is of sufficient diameter and depth to allow for the portable pool cleaning system 120 to be threadedly attached to the deck 208 and thus secure the portable pool cleaning system 120 during the temporary cleaning use. In this embodiment, the portable pool cleaning system 120 includes a threaded bolt which can then be inserted into the prethreaded pipe 300.

Referring now to FIG. 4, a secondary base 400 is physically attached to the pool deck 208 and remains attached to the pool deck 208 after the portable pool cleaning system 120 has been removed. The secondary base 400 is fixedly attached to the deck 208 thus providing a secure foundation on which to attached the portable pool cleaning system 120. Quick attach tab slots 402*a* and 402*b* are embedded within the secondary base 400 so that as the portable pool cleaning device system 120 is placed on top of the secondary base 400, then tab inserts of the portable pool cleaning system 120 (not shown) will engage the tab insert slots 402*a* and 402*b* thus securely attaching the portable pool cleaning system 120 to the pool deck 208. A wide variety of attachment functions or schemes can be implemented without detracting from the spirit of the invention. The attachment schemes and functions require that the portable pool cleaning system 120 be securely attached to the deck 208 or periphery of the swimming pool 206.

Other embodiments of the invention will be apparent to those skilled in the art after considering this specification or practicing the disclosed invention. The specification and examples above are exemplary only, with the true scope of the invention being indicated by the following claims.

What is claimed is:

1. A pool cleaning system for cleaning of a swimming pool, the swimming pool surrounded at least partially by a deck, the system comprising:

a frame;

a motor attached to the frame;

a ground fault interrupter positioned between the motor and a power source, the ground fault interrupter disrupting a current flow from the power source upon a detection of current above a predetermined level;

a pump connected to the motor, wherein the pump includes an intake port and an output port;

a first tubing connected to the intake port, the first tubing including first and second ends, the second end of the first tubing for insertion into the swimming pool and for transporting water contained in the swimming pool to the pump;

a second tubing connected to the output port, the second tubing including first end and second end, wherein the second tubing forms a handle for gripping;

an automated activation means for activating the pool cleaning system at a specific time;

and an attachment bolt engaging the frame, the attachment bolt for insertion into a threaded pipe attached to the deck, the attachment bolt for securely attaching the frame to the deck.

2. The pool cleaning system of claim 1, wherein the motor is an electric motor.

3. The pool cleaning system of claim 1, wherein the motor is a gas powered motor.

4. The pool cleaning system of claim 1, wherein the high pressure pump is a 0.75 bp booster pump.

5. The pool cleaning system of claim 1 further comprising a filtration system connected to the intake port, the filtration system for removing debris from the water of the swimming pool.

6. The pool cleaning system of claim 1 further comprising a filtration system connected to the first tubing, the filtration system for removing debris from the water of the swimming pool.

7. The pool cleaning system of claim 1, wherein the motor includes a 120 Volt motor.

8. The pool cleaning system of claim 1 further comprising a self propelled cleaning device attached to the second end of the second tubing.

9. The portable pool cleaning system of claim 1, wherein the attachment bolt includes hand tightenable attachment bolts.

* * * * *